US011732498B2

(12) United States Patent
Cochrane

(10) Patent No.: US 11,732,498 B2
(45) Date of Patent: Aug. 22, 2023

(54) RAZOR WIRE FENCE PANEL

(71) Applicant: COCHRANE STEEL PRODUCTS (PTY) LTD, Kempton Park (ZA)

(72) Inventor: Richard Bruce Cochrane, Kempton Park (ZA)

(73) Assignee: COCHRANE STEEL PRODUCTS (PTY) LTD, Kempton Park (ZA)

( * ) Notice: Subject to any disclaimer, the term of this patent is extended or adjusted under 35 U.S.C. 154(b) by 393 days.

(21) Appl. No.: 16/682,193

(22) Filed: Nov. 13, 2019

(65) Prior Publication Data

US 2020/0149308 A1 May 14, 2020

(30) Foreign Application Priority Data

Nov. 13, 2018 (ZA) ..... 2018/07605

(51) Int. Cl.
*E04H 17/16* (2006.01)
*E04H 17/04* (2006.01)

(52) U.S. Cl.
CPC ..... *E04H 17/163* (2013.01); *E04H 17/045* (2021.01)

(58) Field of Classification Search
CPC ..... E04H 17/02; E04H 17/04; E04H 17/045; E04H 17/05
See application file for complete search history.

(56) References Cited

U.S. PATENT DOCUMENTS 1,014,525 A * 1/1912 Schneider ..... A47C 23/155 245/5
4,526,347 A * 7/1985 McLoughlin ..... E04H 17/04 245/5
4,725,044 A * 2/1988 Cluff ..... E04H 17/066 245/11
5,421,557 A * 6/1995 Vise ..... E04H 17/003 256/22
5,556,080 A * 9/1996 Vise ..... E04H 17/003 256/22
7,044,447 B2 * 5/2006 Cano ..... E06B 9/02 256/33
8,864,109 B2 * 10/2014 Cochrane ..... E04H 17/16 256/34
11,066,845 B2 * 7/2021 Beagen ..... E04H 17/003
2007/0138454 A1 * 6/2007 Yeo ..... E04H 17/04 256/2

* cited by examiner

*Primary Examiner* — Daniel J Wiley
(74) *Attorney, Agent, or Firm* — Nixon & Vanderhye

(57) ABSTRACT

Disclosed is a fence panel including a rectangular mesh body which includes a plurality of lengths of razor wire arranged to form a plurality of diamond-shaped mesh apertures, each aperture having a major axis of length L and a minor axis of length L/2, and wherein the lengths of razor wire are fixed to one another at respective junctions, wherein L≤200 mm.

17 Claims, 1 Drawing Sheet

RAZOR WIRE FENCE PANEL

BACKGROUND OF THE INVENTION

This invention relates to a fence panel which is formed from razor wire.

A razor mesh fence panel is formed by welding together, at respective points of contact, two arrays of transversely disposed and parallel lengths of razor wire which are positioned to form diamond-shaped mesh apertures. To a considerable extent, in some markets, the mesh panels have been standardized in that each aperture has a major axis with a length of the order of 300 mm and a minor axis with a length of the order of 150 mm.

Edges of the mesh panel are defined by relatively short ends of the razor wires which project from adjacent welding points. It has been found that, at the time of manufacture, the mesh panel, along its edges, has a regular and acceptable appearance. However, due to forces which are exerted during storage, transport and erection of the fence panels, it frequently occurs that the projecting ends, at the edges of a panel, are easily bent. The deformation of the razor wires at the edges of the panel detract from the appearance of an erected fence. To address this drawback a stiffening component is attached to the edges of the panel. For example, strip material has been welded to the projecting ends of the razor wire. This remedial action can however be cumbersome to undertake and adds unnecessarily to the cost of the final product.

A mesh panel with an aperture of this size does present a formidable deterrent but, nonetheless, the panel can be scaled by a person with adequate protection who can place a foot into each diamond mesh aperture and thereby climb over the panel. The deterrent effect can be improved if two of the panels are used with a first panel superimposed over a second panel but being displaced in a lateral sense so that effectively the wires in one panel divide each mesh aperture in the adjacent panel into four smaller, diamond-shaped apertures. The resulting combination of panels is however expensive and heavy and difficult to handle. Apart therefrom the projecting ends of the razor wire exhibit the drawback referred to.

An object of the present invention is to provide a fence panel which, at least to some extent, addresses the aforementioned factors.

SUMMARY OF INVENTION

The applicant has found that, surprisingly, the tendency of the razor wires at the edges of the panel, to be deformed during transport, erection etc can be prevented, to a substantial extent, if the size of each mesh aperture is reduced. To achieve this the invention provides a fence panel which comprises a rectangular mesh body with first and second opposed parallel edges, and third and fourth opposed parallel edges, wherein the body comprises a plurality of lengths of razor wire arranged to form a plurality of diamond-shaped mesh apertures, each aperture having a major axis of length L and a minor axis of length L/2, wherein the lengths of razor wire are fixed to one another at respective junctions, and wherein the junctions which are closest to the first edge are spaced apart from one another and located on a line which is parallel to and spaced from the first edge by a distance D, and wherein $D \leq 0.25$ L and $L \leq 200$ mm.

The body of the fence panel may comprise a first array of a first plurality of elongate parallel and spaced apart first lengths of razor wire and a second array of a second plurality of elongate parallel and spaced apart second lengths of razor wire, wherein the first array transversely overlies the second array thereby forming a plurality of diamond-shaped mesh apertures, each aperture having a major axis of length L and a minor axis of length L/2, the first lengths being respectively fixed to the second lengths at each junction at which a first length overlies and contacts a second length.

Preferably L=200 mm. Thus L/2=100 mm.

Preferably $D \leq 0.2 \times L$, i.e. $D \leq 40$ mm.

In use of the panel the mesh body is preferably positioned with the first edge uppermost and horizontal, and with the major axis of each mesh aperture extending vertically.

BRIEF DESCRIPTION OF THE DRAWINGS

The invention is further described by way of example with reference to the accompanying drawings in which.

DESCRIPTION OF PREFERRED EMBODIMENT

Figure 1:
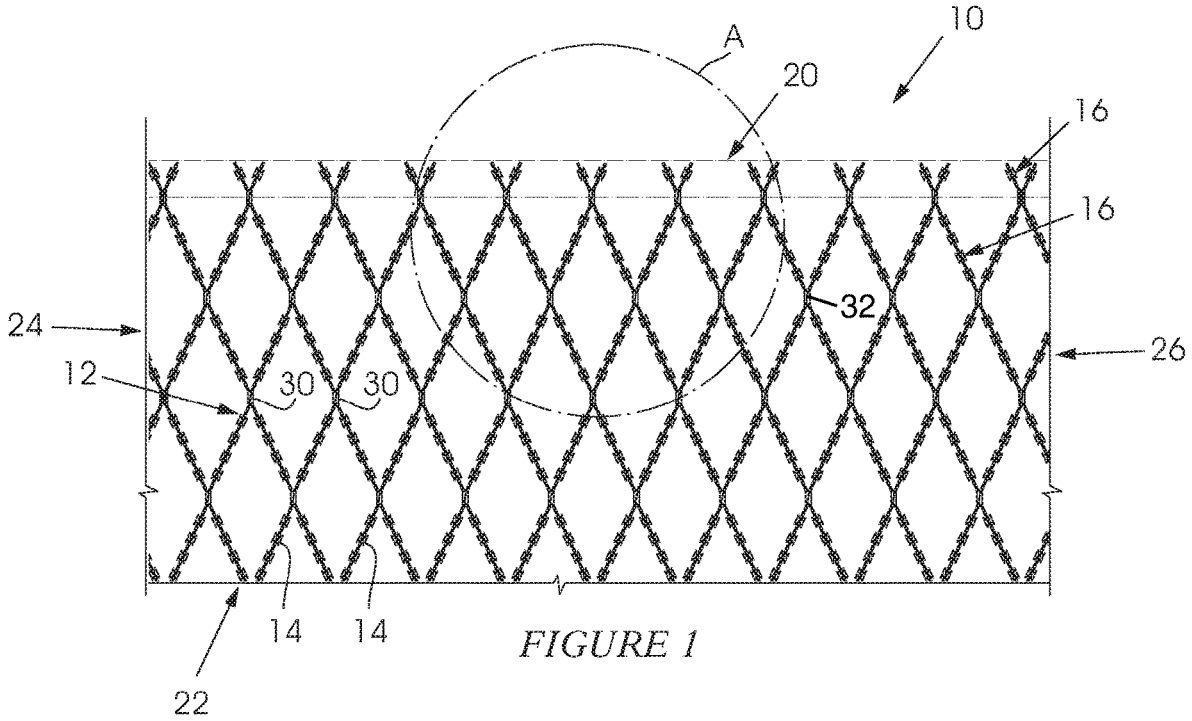
FIG. 1 shows a fence panel according to the invention which is made from a plurality of lengths of razor wire fixed together.

FIG. 1 of the accompanying drawings illustrates a fence panel 10 according to the invention. The panel 10 comprises a rectangular body 12 formed from transverse lengths 14 and 16 of razor wire arranged to form a diamond mesh configuration. The body 12 has opposed first and second parallel edges 20 and 22 respectively and opposed third and fourth parallel edges 24 and 26 respectively. The edges 24 and 26 are at a right angle to the edges 20 and 22.

The lengths 14 of razor wire are parallel to and are equally spaced apart from one another, and are arranged in a first array. The lengths 16 of razor wire are parallel to and are equally spaced apart from one another and are in a second array extending transversely to the first array. At junctions 30 at which the lengths 16 overlie and are in contact with the lengths 14, the wires are fixed together. The drawings illustrate that, in this respect, clips 32 are used to secure adjacent lengths of wire together. It is also possible though to weld the wires together at the respective points of intersection.

Figure 2:
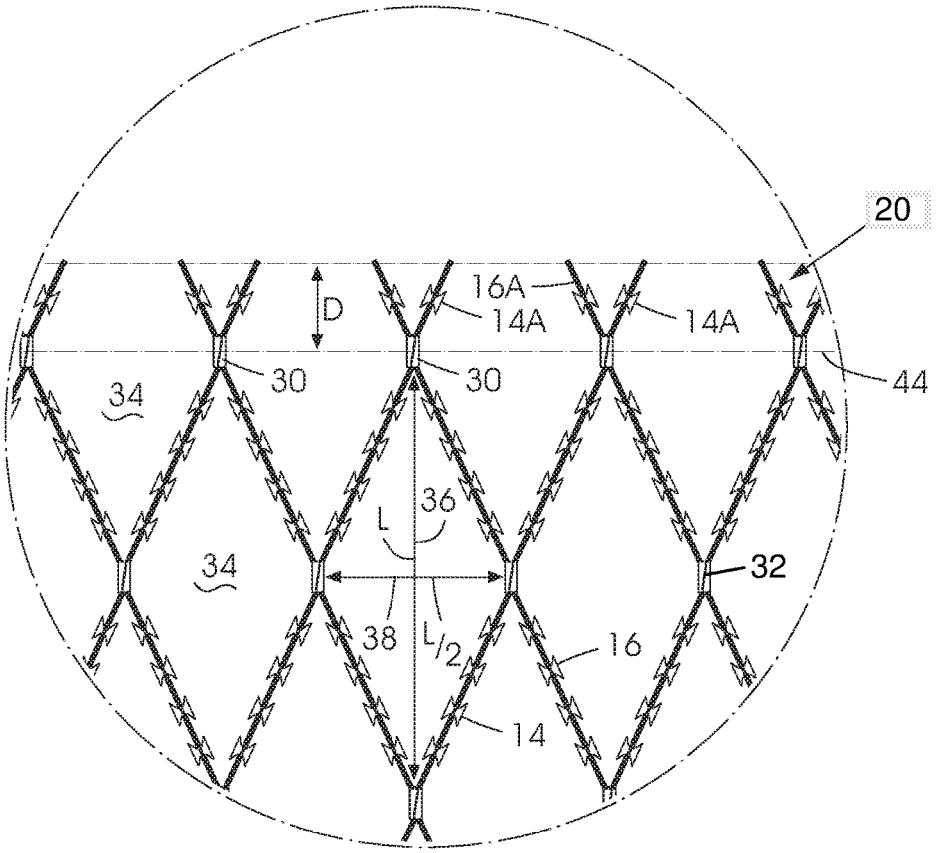
FIG. 2 illustrates a portion of the fence panel in FIG. 1, on a larger scale than what is shown in FIG. 1.

FIG. 2 is a view on an enlarged scale of a portion of the razor mesh panel shown in FIG. 1 enclosed in a circle marked A. The razor wire lengths 14 and 16 form diamond-shaped mesh apertures 34 each of which has a major axis 36 of length L and a minor axis 38 of length L/2. FIG. 2 shows the first edge 20 and those junctions 30 at which the contacting razor wire lengths 16 and 14 are secured together and which are closest to the first edge 20. These junctions are on a line 44 (shown as a dotted line) which is parallel to, and spaced from, the edge 20 by a distance D between the first edge 20 and the junction line 44. The lengths 14 and 16 have respective projecting portions 14A and 16A.

In the "standardized" razor mesh panel referred to hereinbefore L is of the order of 300 mm. Thus L/2, i.e. the minor axis 38, is of the order of 150 mm. What the applicant has found is that if L is reduced to 200 mm, i.e. the diamond aperture 34 has a major axis 36 of 200 mm and a minor axis 38 of 100 mm, the deterrent effect of the fence panel is significantly enhanced but, almost of equal importance, is the fact that with $D \leq 0.25$ L i.e. $\leq 50$ mm there is a reduced tendency for the projecting portions 14A and 16A of the razor wires adjacent the first edge 20 to be deformed or bent during handling or erection of a fence panel. Thus in a preferred embodiment L=200 mm, L/2=100 mm and D is of the order of 40 mm.

The enhanced deterrent effect does however require more razor wire to be included in the panel than in the standardized panel, referred to hereinbefore, but far less razor wire is used than if two standardized panels were to be fixed together.

The invention claimed is:

1. A fence panel, comprising:

a rectangular mesh body, with first and second opposed parallel horizontal edges, and third and fourth opposed parallel vertical edges, wherein the mesh body comprises a plurality of lengths of razor wire arranged to form a plurality of diamond-shaped mesh apertures, each aperture having a vertical major axis of length Land a horizontal minor axis of length L/2, wherein the lengths of razor wire are fixed to one another at respective junctions, wherein the junctions which are closest to the first edge are spaced apart from one another and located on a line which is parallel to and spaced from the first edge by a distance D such that free ends of the razor wire extend as projecting portions from said closest junctions by a non-zero length, wherein the projecting portions include at least one barb between the line and the first edge, and wherein $0<D\leq 0.25\times L$ and $L\leq 200$ mm.

2. The fence panel according to claim 1, wherein the mesh body is formed of a first array of a first plurality of elongate parallel and spaced apart first lengths of razor wire, and a second array of a second plurality of elongate parallel and spaced apart second lengths of razor wire, and wherein the first array transversely overlies the second array thereby forming a plurality of diamond-shaped mesh apertures, each aperture having a major axis of length L and a minor axis of length L/2, the first lengths being respectively fixed to the second lengths at each junction at which a first length overlies and contacts a second length.

3. The fence panel according to claim 1, wherein L=200 mm.

4. The fence panel according to claim 1, wherein L/2=100 mm.

5. The fence panel according to claim 1, wherein D=40 mm.

6. The fence panel according to claim 2, wherein L=200 mm.

7. The fence panel according to claim 2, wherein L/2=100 mm.

8. The fence panel according to claim 2, wherein D=40 mm.

9. The fence panel according to claim 1, wherein $0<D\leq 40$ mm.

10. A fence which includes a plurality of fence panels, each fence panel comprising:

a rectangular mesh body, with first and second opposed parallel edges, and third and fourth opposed parallel edges, the mesh body being positioned with the first edge uppermost and horizontal, wherein the mesh body comprises a plurality of lengths of razor wire arranged to form a plurality of diamond-shaped mesh apertures, each aperture having a vertical major axis of length Land a horizontal minor axis of length L/2, wherein the lengths of razor wire are fixed to one another at respective junctions, and wherein the junctions which are closest to the first edge are spaced apart from one another and located on a line which is parallel to and spaced from the first edge by a distance D such that free ends of the razor wire extend as projecting portions from said closest junctions by a non-zero length, wherein the projecting portions include at least one barb between the line and the first edge, where $0\leq DS\leq 0.25\times L$.

11. The fence according to claim 10 wherein in respect of each said fence panel the respective mesh body is formed of a first array of a first plurality of elongate parallel and spaced apart first lengths of razor wire, and a second array of a second plurality of elongate parallel and spaced apart second lengths of razor wire, and wherein the first array transversely overlies the second array thereby forming said plurality of diamond-shaped mesh apertures, each aperture having a major axis of length L and a minor axis of length L/2, the first lengths being respectively fixed to the second lengths at each junction at which a first length overlies and contacts a second length.

12. The fence according to claim 10, wherein L=200 mm.

13. The fence according to claim 10, wherein L/2=100 mm.

14. The fence according to claim 11, wherein L=200 mm.

15. The fence according to claim 11, wherein L/2=100 mm.

16. The fence according to claim 11, wherein $D\leq 40$ mm.

17. The fence according to claim 10, wherein $0\leq D\leq 40$ mm.

* * * * *